US006863544B2

(12) United States Patent
Haehn et al.

(10) Patent No.: US 6,863,544 B2
(45) Date of Patent: Mar. 8, 2005

(54) REMOTE DIAGNOSTIC UNIT ENCLOSURE ASSEMBLY

(75) Inventors: Craig S. Haehn, Avon Lake, OH (US); Duane R. Johnson, Wellington, OH (US); Park E. Larson, Austintown, OH (US); Robert J. Custer, Westlake, OH (US)

(73) Assignee: Bendix Commercial Vehicle Systems LLC

( * ) Notice: Subject to any disclaimer, the term of this patent is extended or adjusted under 35 U.S.C. 154(b) by 0 days.

(21) Appl. No.: 10/605,243

(22) Filed: Sep. 17, 2003

(65) Prior Publication Data

US 2004/0137768 A1 Jul. 15, 2004

Related U.S. Application Data

(60) Provisional application No. 60/429,463, filed on Nov. 27, 2002.

(51) Int. Cl.[7] ..... H01R 13/42
(52) U.S. Cl. ..... 439/76.1
(58) Field of Search ..... 439/76.1

(56) References Cited

U.S. PATENT DOCUMENTS

| | | | | | |
|---|---|---|---|---|---|
| 3,784,963 | A | * | 1/1974 | DeCenzo | 439/76.1 |
| 4,187,388 | A | * | 2/1980 | Roberts | 439/592 |
| 5,046,966 | A | * | 9/1991 | Snyder et al. | 439/579 |
| 6,074,242 | A | * | 6/2000 | Stefaniu et al. | 439/441 |
| 6,616,480 | B2 | * | 9/2003 | Kameyama | 439/76.1 |

* cited by examiner

*Primary Examiner*—Renee Luebke
(74) *Attorney, Agent, or Firm*—Calfee, Halter & Griswold LLP

(57) ABSTRACT

An electrical connector is disclosed, having a removable printed circuit board. The printed circuit board is capable of electrical connection with pins extending through a connector body and a spacer and is capable of electrical connection with lead wires. The printed circuit board has keying elements to ensure proper alignment with the pins. A lens piece cooperates with the printed circuit board to enable visibility of at least one light emitting diode on the printed circuit board. The lens piece, printed circuit board, and spacer are held in place by a collar engaged with the connector body.

13 Claims, 1 Drawing Sheet

REMOTE DIAGNOSTIC UNIT ENCLOSURE ASSEMBLY

CROSS REFERENCE TO RELATED APPLICATIONS

This application claims the benefit under 35 U.S.C. §119 (e) of U.S. Provisional Application No. 60/429,463 filed Nov. 27, 2002, titled REMOTE DIAGNOSTIC UNIT ENCLOSURE ASSEMBLY, which application is hereby incorporated by reference in its entirety.

BACKGROUND OF INVENTION

The present invention generally relates to connectors between two units, each having a set of electrical contacts, and, more particularly, to a connector system for a vehicle remote diagnostic unit having a printed circuit board.

Connectors are commonly used to connect plug and receptacle elements having electrical contacts together. Often, connectors include a receptacle having at least one male connector, such as a pin, housed in a housing mating with a plug having at least one female connector housed in a housing to establish a connection between electrical contacts in the receptacle and the plug. In some applications, the connection between the contacts is difficult without a more permanent manner of connection, such as by soldering the contacts or other elements together.

One example is the connection of pins or lead wires in a vehicle diagnostic system connection to a printed circuit board, such as associated with a remote diagnostic unit. Typically, the connection of pins or lead wires to the printed circuit board is accomplished by soldering of the pins or lead wires to the respective contacts on the printed circuit board. Such soldering may leave the printed circuit board vulnerable to damage in handling and possibly compromise the integrity of the board.

SUMMARY OF INVENTION

The present invention provides solderless connectors mounted on a printed circuit board, for connection with pins or lead wires, such as from a vehicle diagnostic connection. The lead wires are threaded through a spacer into contact with the solderless connectors. The printed circuit board has a set of keying elements to ensure proper alignment of the board with the wires and a connector body, such as that associated with the vehicle diagnostic connection. A lens piece having at least one lens is adjacent to the printed circuit board and aligned such that the at least one lens is positioned over at least one corresponding light emitting diode on the printed circuit board.

A collar, within which are disposed the lead wires, spacer, printed circuit board, and lens piece, is attached to the connector body and tightened, drawing the wire leads into their final connection with the solderless connectors on the printed circuit board.

This allows for the use of standard connector pins with solid conductor leads for contact with the printed circuit board. It also allows the unit to be assembled anywhere without an additional soldering operation to connect the printed circuit board. The modular design makes disassembly and interchangeability of boards for varying applications possible. The self-aligning, keyed components are stacked together and held in place by a simple collar. The connection of the pins to the printed circuit board is made automatically as the collar draws the components together at assembly. This assembly has particular application as a remote diagnostic unit enclosure assembly for use with a diagnostic system associated with a tractor-trailer or other heavy vehicle.

BRIEF DESCRIPTION OF DRAWINGS

The invention may take form in various components and arrangements of components, and in various steps and arrangements of steps. The drawing is only for purposes of illustrating a preferred embodiment and is not to be construed as limiting the invention.

DETAILED DESCRIPTION

Figure 1:
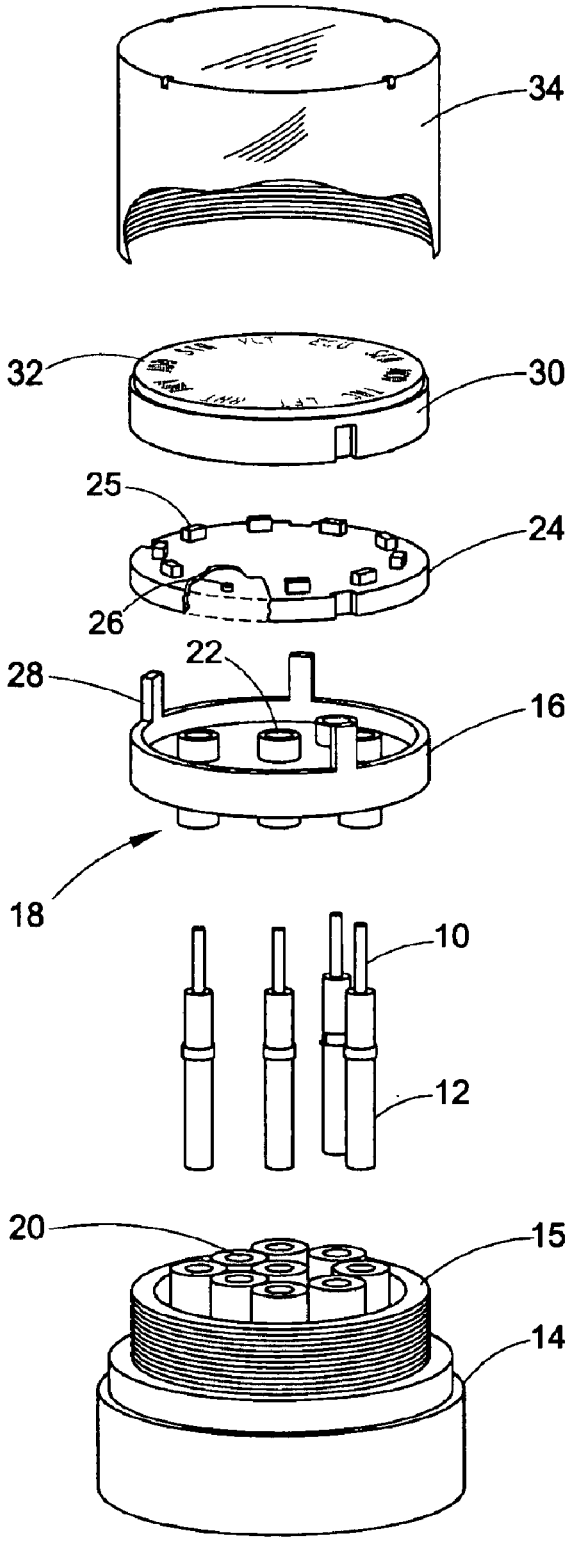
FIG. 1 is an exploded perspective view of a remote diagnostic unit enclosure assembly in accordance with the present invention.

The present invention is directed to connectors for connecting electrical contacts without the need for soldering the contacts together. While the invention is described in terms of electrical connections between pins or lead wires and a printed circuit board in the context of a remote diagnostic unit for a vehicle diagnostic system, the invention is limited only as set forth in the claims, and other applications will be appreciated by those of ordinary skill in the art without departing from the spirit and scope of the invention.

Unless otherwise specified, use of the term "or" herein is the inclusive, and not the exclusive, use. See Bryan A. Garner, A Dictionary of Modern Legal Usage 624 (2d Ed. 1995).

Typically, light emitting diodes (LEDs) on board a vehicle electronic control unit (ECU) are used to indicate a finite number of faults. An operator may reset and/or auto-configure the ECU (e.g., via a switch) as a function of the on/off condition of the LEDs. In this sense, the LEDs are used as a first step in diagnosing a failure in an antilock brake system (ABS). However, recent trends in locating ABS/automatic traction control (ATC) ECUs have tended to make on-board LEDs non-functional to the user in certain applications (e.g., where LEDs are hidden or difficult to see due to ECU location/orientation). In addition, the cost of on-board LEDs introduces unnecessary burdens on the manufacturer and buyer in the cases where LEDs are not used but deemed important.

A remote diagnostic unit (RDU), in which the LED diagnostics are separated from the ECU, may be used that provides the full functionality of the on-board LED concept in an inexpensive and convenient package. The packaging is such that it may be installed on a vehicle and remain in place for the lifetime of the vehicle, if desired.

Many vehicles, especially tractor-trailer and other heavy vehicles, are equipped with a 6-pin or 9-pin diagnostics connector, which already provides easy access to the ABS/ECU via serial communication. This connector also provides a power connection. The present invention uses the existing diagnostics outlet on the vehicle and communicates to the ABS/ATC ECU via serial communications to receive the fault status and display such status on the RDU LEDs.

The present invention integrates the connector, communication device, and display device into a single piece that is not much larger than the connector and can serve the function of the dust cap installed on the vehicle diagnostics connector if the connection is not in use.

Preferably, the diagnostics connector is of a type known as a Deutsch connector, marketed by Deutsch Industrial Products Division, having several pins that connect with a printed circuit (PC) board in the RDU. The present invention, however, is not limited by the type or brand of diagnostics connector, so long as there are pins or lead wires or other contacts available for connection with the PC board.

The present invention includes a connector which mates with a Deutsch connector on a heavy vehicle. As can be seen from FIG. 1, solid conductor lead wires 10 are crimped into standard Deutsch pins 12, which are then inserted into the connector body 14 via a rubber, wire seal 15. A spacer 16 is then stacked onto the connector over the lead wires 10. The spacer 16 has protrusions 18 that mate with the unused wire passages 20 in the rubber seal of the connector body 14 keying the spacer 16 to the connector body 14. The protrusions 18 also utilize the rubber seal 15 to take up tolerances in the assembly and hold the components tightly in place.

The spacer 16 has holes/wire guides 22 through which the lead wires 10 from the connector pins 12 pass. The printed circuit board (PCB) 24 has solderless connectors 26 to receive the lead wires 10 from the pins 12. The PCB 24 is positioned on the spacer 16 by a set of keying elements 28, which ensure alignment of the lead wires 10 to the solderless connectors 26 as well as orient the PCB 24 relative to the connector. One or more light emitting diodes (LEDs) 25 are positioned on the PCB 24.

A lens piece 30 is then stacked onto the PCB 24 and again located and positioned by the same keying elements 28 that locate the PCB 24. The lens piece 30 has a series of smaller, labeled lenses 32 that are positioned over the appropriate LEDs 25 on the PCB 24. The entire assembly is then drawn together and held in place by a threaded collar 34 cooperating with the connector body 14. As the collar 34 is tightened, the wire leads 10, guided by the spacer 16, are pushed into their final contact position with the solderless connectors 26 on the PCB 24.

In another embodiment, the collar 34 and lens piece 30 are a unitary piece. In yet another embodiment, the collar 34 is not threaded, but snaps into position, such as with a friction fit, to retain the other components.

The design can utilize standard production connectors or custom molded connectors. If a custom connector is utilized, the standard connector pins and solderless connectors 26 on the PCB 24 can be replaced with spring loaded pins which make contact directly with pads on the PCB 24. Seals can be incorporated to make the unit more resistant to contamination.

The modular aspect of the design allows for interchangeability of printed circuit boards 24 and lens pieces 30 for various other applications.

While the present invention has been illustrated by the above description of embodiments, and while the embodiments have been described in some detail, it is not the intention of the Applicants to restrict or in any way limit the scope of the invention to such detail. Additional advantages and modifications will readily appear to those skilled in the art. Therefore, the invention in its broader aspects is not limited to the specific details, representative apparatus and methods, and illustrative examples shown and described. Accordingly, departures may be made from such details without departing from the spirit or scope of the Applicants" general or inventive concept.

What is claimed is:

1. An electrical connector, comprising:

a. a connector body including a threaded portion;

b. wires extending through the connector body;

c. a spacer cooperating with the connector body and through which the wires extend;

d. printed circuit board having connectors thereon and having at least one light emitting diode;

e. a lens piece having at least one lens; and f. a collar including a threaded portion, the collar threaded portion being capable of engagement with the connector body threaded portion;

wherein the wires removably contact the connectors via pressure engagement for providing an electrical connection between the wires and the printed circuit board.

2. The electrical connector of claim 1, wherein the printed circuit board is removable and replaceable.

3. The electrical connector of claim 1, wherein the lens piece is removable and replaceable.

4. The electrical connector of claim 1, wherein the lens piece cooperates with the at least one light emitting diode on the printed circuit board.

5. The electrical connector of claim 1, wherein the collar secures the lens piece, the printed circuit board, and the spacer when in engagement with the connector body.

6. The electrical connector of claim 1, wherein the connectors are solderless connectors; and the wires are held in the electrical connection with the solderless connectors when the collar is engaged with the connector body.

7. An electrical connector comprising:

a. a connector body;

b. wires extending through the connector body;

c. a spacer cooperating with the connector body and through which the wires extend;

d. printed circuit board having connectors thereon and having at least one light emitting diode;

e. a lens piece having at least one lens; and f. a collar capable of engagement with the connector body;

wherein the wires removably contact the connectors via pressure engagement for providing an electrical connection between the wires and the printed circuit board; and wherein the printed circuit board comprises keying elements capable of cooperating with the spacer to properly align the printed circuit board with the wires extending through the spacer.

8. A remote diagnostic unit having at least one light emitting diode for a vehicle diagnostic system, comprising:

a. a printed circuit board comprising connectors and at least one light emitting diode;

b. a connector body including a threaded portion;

c. wires, extending through the connector body, removably cooperating with the connectors via pressure engagement for providing an electrical connection between the wires and the printed circuit board;

d. a spacer between the printed circuit board and the connector body;

e. a lens piece having at least one lens for cooperation with the at least one light emitting diode on the printed circuit board; and f. a collar including a threaded portion, the collar threaded portion being capable of engagement with the connector body threaded portion to house the lens, the printed circuit board, and the spacer.

9. The remote diagnostic unit of claim 8, wherein the printed circuit board is removable and replaceable.

10. The remote diagnostic unit of claim 8, wherein the lens piece is removable and replaceable.

11. The remote diagnostic unit of claim 8, wherein the collar secures the lens piece, the printed circuit board, and the spacer when in engagement with the connector body.

12. The remote diagnostic unit of claim 8, wherein; the connectors are solderless connectors; and the wires are held in electrical connection with the solderless connectors when the collar is engaged with the connector body.

13. A remote diagnostic unit having at least one light emitting diode for a vehicle diagnostic system, comprising:

a. a printed circuit board comprising connectors and at least one light emitting diode;

b. a connector body;

c. wires, extending through the connector body, removably cooperating with the connectors via pressure engagement for providing an electrical connection between the wires and the printed circuit board;

d. a spacer between the printed circuit board and the connector body;

e. a lens piece having at least one lens for cooperation with the at least one light emitting diode on the printed circuit board; and f. a collar capable of engagement with the connector body to house the lens, the printed circuit board, and the spacer;

wherein the printed circuit board comprises keying elements capable of cooperating with the spacer to properly align the printed circuit board with the wires extending through the spacer.

* * * * *